US007860411B2

(12) United States Patent
Toda

(10) Patent No.: US 7,860,411 B2
(45) Date of Patent: Dec. 28, 2010

(54) PRINTING APPARATUS AND PRINTING PROCESSING METHOD

(75) Inventor: Masayuki Toda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 11/463,040

(22) Filed: Aug. 8, 2006

(65) Prior Publication Data

US 2007/0036598 A1 Feb. 15, 2007

(30) Foreign Application Priority Data

Aug. 15, 2005 (JP) ..... 2005-235489

(51) Int. Cl.
*G03G 15/00* (2006.01)

(52) U.S. Cl. ..... 399/18; 399/15; 399/366; 399/385; 399/390; 399/407

(58) Field of Classification Search ..... 399/18, 399/407, 366, 15, 385, 390
See application file for complete search history.

(56) References Cited

U.S. PATENT DOCUMENTS

| | | | | |
|---|---|---|---|---|
| 4,279,200 | A * | 7/1981 | Newcomb | 101/170 |
| 4,760,247 | A * | 7/1988 | Keane et al. | 235/454 |
| 4,891,681 | A * | 1/1990 | Fiske et al. | 399/385 |
| 5,548,691 | A * | 8/1996 | Sato et al. | 358/1.14 |
| 5,745,248 | A * | 4/1998 | Nickerson | 358/296 |
| 2003/0021610 | A1 * | 1/2003 | Shimizu et al. | 399/44 |
| 2005/0166744 | A1 * | 8/2005 | Berge et al. | 83/879 |

FOREIGN PATENT DOCUMENTS

| | | |
|---|---|---|
| JP | 11-039492 | 2/1999 |
| JP | 2002-127634 A | 5/2002 |
| JP | 2004-077208 A | 3/2004 |
| JP | 2004-090644 A | 3/2004 |

OTHER PUBLICATIONS

The above references were cited in a Jul. 3, 2009 Japanese Office Action that issued in Japanese Patent Application No. 2005-235489, which is enclosed without an English Translation.

* cited by examiner

*Primary Examiner*—Judy Nguyen
*Assistant Examiner*—Andy L Pham
(74) *Attorney, Agent, or Firm*—Cowan, Liebowitz & Latman, P.C.

(57) ABSTRACT

The presence/absence of a printing failure on a printed product is accurately detected to prevent a defective product from mixing in printed products to be delivered to a customer. In order to achieve this object, a printing processing method according to this invention includes steps of inputting first image data, executing the printing process for a printing medium based on the first image data, reading the printing medium on which the first image data is printed to obtain second image data, specifying a determination area to be used to determine the presence/absence of a printing failure in the second image data based on a processing content after the printing process for the printing medium, and determining the presence/absence of the printing failure by comparing the first image data and the second image data corresponding to the determination area.

8 Claims, 14 Drawing Sheets

PRINTING APPARATUS AND PRINTING PROCESSING METHOD

BACKGROUND OF THE INVENTION

1. Field of the Invention

The present invention relates to a processing technique for determining the presence/absence of a printing failure in a printing apparatus which prints image data on a predetermined medium on which image data is printed.

2. Description of the Related Art

Conventionally, in the commercial printing industry, a printed product is issued through various work processes. The work processes include, for example, document entry, layout editing, proofreading (layout correction and color correction), proof printing, block copy preparation, printing, post process, checking, and shipping.

Especially, since an offset printing press is mainly used in printing in the commercial printing industry, it is essential to prepare a block copy. However, once the block copy is prepared, it is difficult and costly to correct the block copy. Thus, careful proofreading (i.e., careful layout check and color confirmation) is indispensable for preparing the block copy. Accordingly, a predetermined period of time is generally taken to completely issue the printed product.

In such a situation, higher-speed and higher-image quality electrophotographic and inkjet printing apparatuses have been introduced. A market called print-on-demand (to be referred to as a POD hereinafter) has appeared in competition with against the commercial printing industry.

POD has appeared in place of the above-mentioned large-scale printing apparatus or printing scheme such that a relatively small-lot job can be handled in a short delivery period without using the large-scale apparatus or system.

In the POD market, digital printing using electronic data can be implemented to provide a printing service by making the best of digital image forming apparatuses such as a digital copying machine and digital multi-function peripheral.

However, in the above-described commercial printing industry or POD market, it is not automatically checked whether there is a printing failure on a printed product to be delivered to a customer. Under the present conditions, an operator manually checks the printed product. When the printed product has several hundred pages, it takes a very long time and many processes to check the printed product in detail for each page. Hence, the checking accuracy becomes rough in practice, and small printing errors, omissions, and dirt on a sheet of paper are not detected, thus posing a problem.

Under these circumstances, a technique of automatically checking the printed product is demanded. Note that a technique of checking a printed product by comparing a verification image for verifying the printed product with an image obtained by sensing the printed product is known as a technique of automatically checking the printed product (see, e.g., Japanese Patent Application Laid-Open No. 11-39492).

However, a conventional checking technique does not consider processing content to be executed for a printed product after printing. For example, in checking a printed product, an entire printed medium need not always be checked. More specifically, when a part of the medium is not used after the printing and cutting processes, this unnecessary portion need not to be checked. If the entire medium is checked even in such a case, it takes a long time and requires a heavy process load to check the medium. Additionally, since a target (area) to be checked becomes large, the checking accuracy may decline.

SUMMARY OF THE INVENTION

The present invention has been made in consideration of the above problems, and has as its object to accurately detect the presence/absence of a printing failure on a printed product to prevent a defective product from mixing in printed products to be delivered to a customer.

In order to achieve the above object, a printing apparatus according to the present invention has the following arrangement. That is, a printing apparatus which executes a printing process for a printing medium, comprising:

an input unit configured to input first image data to be printed on the printing medium;

a printing processing unit configured to execute the printing process for the printing medium based on the first image data input by the input unit;

a reading unit configured to read the printing medium on which the first image data is printed by the printing processing unit to obtain second image data used to determine a presence/absence of a printing failure;

a specifying unit configured to specify a determination area to be used to determine the presence/absence of the printing failure in the second image data based on a processing content after the printing process for the printing medium on which the first image data is printed; and a determination unit configured to determine the presence/absence of the printing failure by comparing the first image data and the second image data corresponding to the determination area.

Upon accurately detecting the presence/absence of a printing failure on a printed product, a defective product can be prevented from mixing in printed products to be delivered to a customer.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will now be described in detail in accordance with the accompanying drawings.

First Embodiment

<Arrangement of MFP>

The arrangement of an MFP (Multi Function Peripheral) serving as a printing apparatus (an apparatus having a printing function) according to the first embodiment of the present invention will be described below with reference to FIG. 1.

The MFP includes a memory such as a hard disk which can store a plurality of job data. The MFP has a copying function capable of printing by a printer unit via the memory in accordance with job data output from a scanner. The MFP also has a print function capable of printing by the printer unit via the memory in accordance with job data output from an external apparatus such as a computer. That is, the MFP is an image forming apparatus having a plurality of functions including the printing function (a printing apparatus serving as an apparatus having the printing function includes the image forming apparatus having the printing function, and the MFP is one example of the image forming apparatuses).

The MFP includes a full-color device and monochrome device. Generally, the arrangement of the full-color device basically includes that of the monochrome device except for a color process and internal data. Hence, the full-color device will be mainly described, and the description of the monochrome device will be added as needed.

Note that the arrangement of the MFP according to this embodiment may include a multi-function image forming apparatus having a plurality of functions, or an SFP (Single Function Peripheral). The SFP is a single-function image forming apparatus having only the print function or the like.

The arrangement may include only one of the MFP- and SFP-type image forming apparatuses. Furthermore, the arrangement may include the plurality of image forming apparatuses of any type. In either case, the arrangement can have any apparatus as far as an information processing method according to this embodiment can be implemented.

Figure 1:
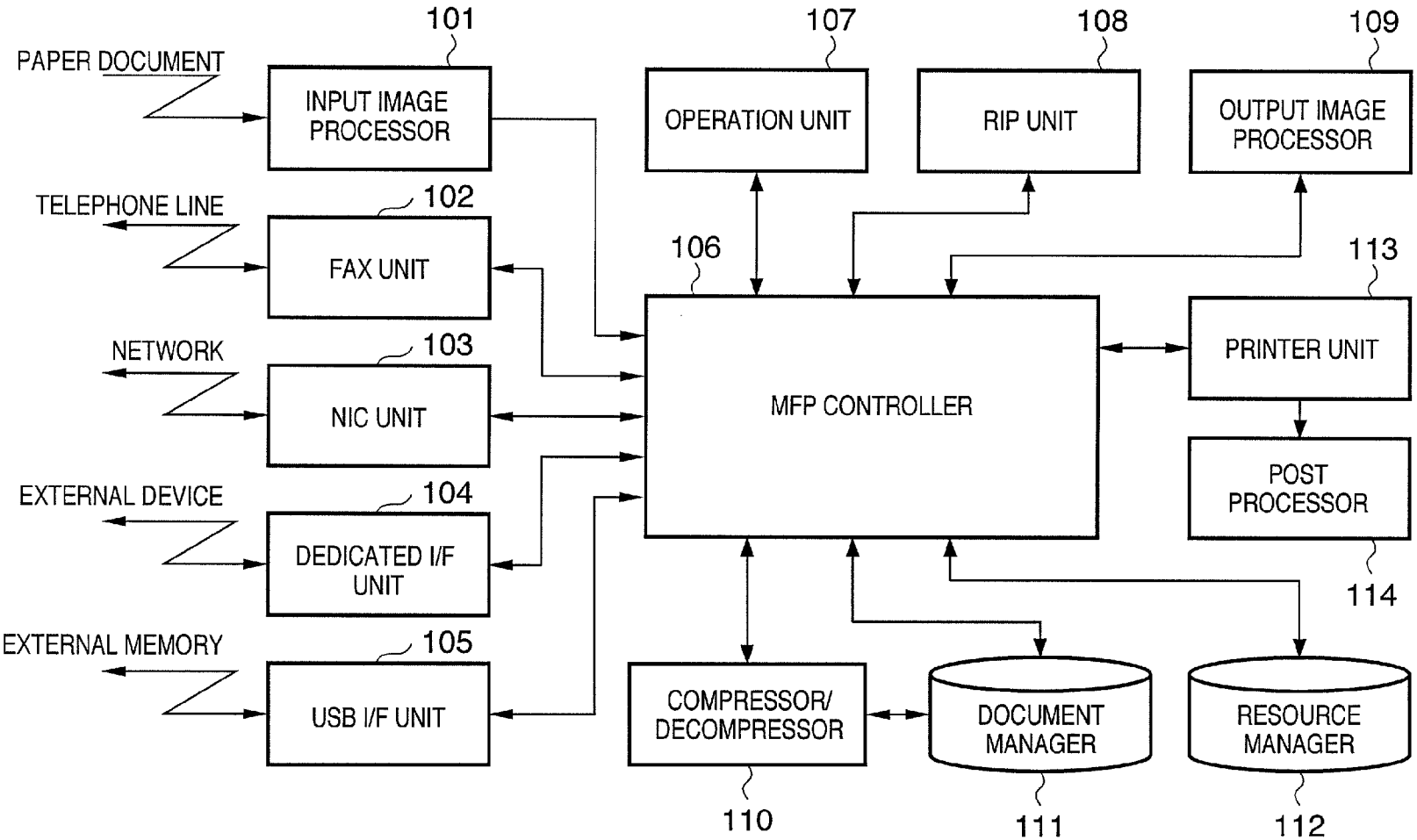
FIG. 1 is a block diagram showing the arrangement of an MFP (Multi Function Peripheral) serving as a printing apparatus according to the first embodiment of the present invention.

In FIG. 1, reference numeral 101 denotes an input image processor which reads an image from a paper document, and processes the read image data; 102, a FAX unit represented by a facsimile apparatus which transmits/receives image data via a telephone line; 103, a NIC (Network Interface Card) unit which exchanges image data and device information using a network; 104, a dedicated interface unit which exchanges information such as image data with an external apparatus; 105, a USB (Universal Serial Bus) interface (USE I/F) unit which transmits/receives image data and the like to/from a USB device represented by a USB memory (as one type of removable media); 106, an MFP controller which provides traffic control functions, e.g., temporarily storing image data depending on each application of the MFP, and determining a route.

A document manager 111 includes a memory such as a hard disk which can store a plurality of image data. A controller (e.g., a CPU in the MFP controller 106) in the MFP mainly controls to store various image data in the memory. For example, image data from the input image processor 101, image data of a facsimile job input via the FAX unit 102, and image data from the external apparatus such as a computer which is input via the NIC unit 103 are available as the image data. Additionally, various image data input via the dedicated I/F unit 104 and USE I/F unit 105 are available.

The image data is properly read out from the memory. The readout image data is transferred to an output unit such as a printer unit 113. The transmitted image data is then controlled to perform an output process such as a print process by using the printer unit 113. Upon instruction from an operator, the image data read out from the memory is controlled to be transferred to an external apparatus such as a computer or other image forming apparatuses.

In order to store the image data in the document manager 111, the image data is compressed and stored as needed. On the other hand, in order to read out the compressed and stored image data, the image data is decompressed to obtain its original image data. These storing and readout processes are executed via a compressor/decompressor 110. It is generally known that a compression data such as JPEG, JBIG, or ZIP is used when data passes through the network. The image data is received by the MFP, and then unarchived (decompressed) by the compressor/decompressor 110.

A resource manager 112 stores various parameter tables such as a font, color profile, and gamma table to be commonly handled to call these data as needed. Furthermore, the resource manager 112 can also store a new parameter table, and correct and update it.

When PDL data is input, the MFP controller 106 causes a RIP unit 108 to perform a RIP (Raster Image Processor) process. An output image processor 109 performs an image process for an image to be printed, as needed. Furthermore, the intermediate data and print ready data (bitmap data for printing, and data obtained by compressing the bitmap data) of the image data obtained in the image process can also be stored again in the document manager 111.

A sheet (a medium on which image data is to be printed) which has been conveyed to the printer unit 113 for forming an image and printed by the printer unit 113 is conveyed to a post processor 114 to execute sorting or finishing of the sheets.

The MFP controller 106 has a function of smoothly flowing a job to perform path switching as will be described below, depending on how to use the MFP. Although it is generally known that the image data is stored as the intermediate data as needed, only an access from/to the document manager 111 will be described below. The processes of the compressor/decompressor 110 and post processor 114 which are used as needed, and the process of the MFP controller 106 serving as the core of the entire apparatus are omitted, and a rough flow will be explained below.

- Copy function: input image processor→output image processor →printer unit
- FAX transmission function: input image processor→FAX unit
- FAX reception function: FAX unit→output image processor→printer unit
- Network scan: input image processor→NIC unit
- Network print: NIC unit→RIP unit→output image processor →printer unit
- Scan to external apparatus: input image processor→dedicated I/F unit
- Print from external apparatus: dedicated I/F unit→output image processor →printer unit Scan to external memory: input image processor→USB I/F unit Print from external memory: USB I/F unit→RIP unit→output image processor→printer unit Box scan function: input image processor→output image processor →document manager Box print function: document manager→printer unit Box reception function: NIC unit→RIP unit→output image processor →document manager Box transmission function: document manager→NIC unit Preview function: document manager→operating unit Other than the above functions, various combinations between functions such as an E-mail service and Web server function can be considered. However, these combinations are omitted.

The box scan function, box print function, box reception function, and box transmission function are processing functions of the MFP which writes/reads out data on/from the document manager 111. The memory in the document manager 111 is divided for each job or user to temporarily store the data, and input/output the data by using a combination of a user ID, password, and the like.

Furthermore, an operation unit 107 selects the above-described various flows and functions, and outputs an operation instruction. As the resolution of the display device of the operation unit 107 increases, image data in the document manager 111 can be previewed, and then printed out if it is OK after confirmation.

<MFP Controller 106>

The MFP controller 106 will be described below with reference to FIG. 2.

Figure 2:
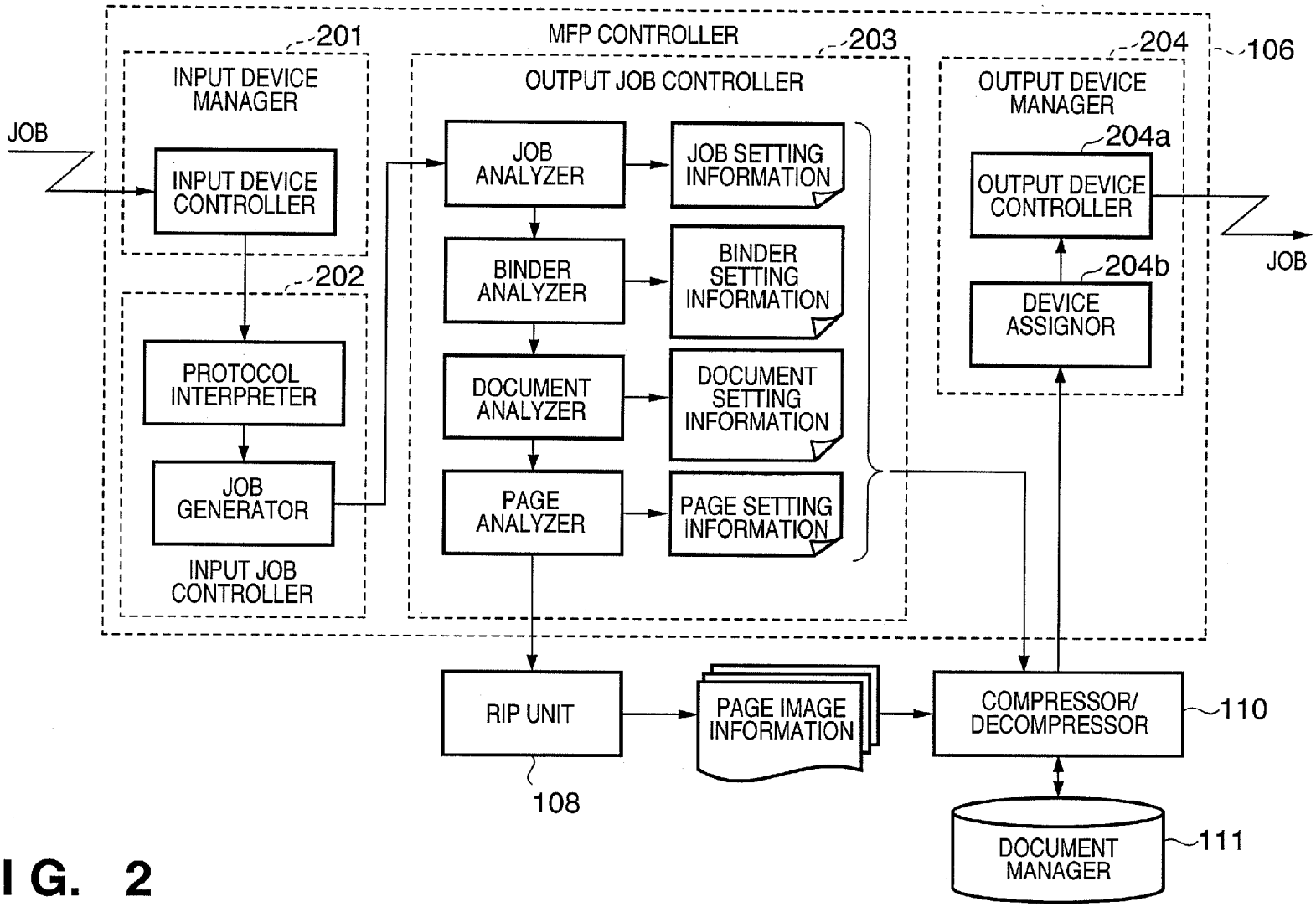
FIG. 2 is a block diagram of an MFP controller.

In FIG. 2, the MFP controller 106 mainly includes four parts, i.e., an input device manager 201 which manages an input device, an input job controller 202 which interprets the input job, an output job controller 203 which arranges pieces of job setting information, and an output device manager 204 which assigns an output device.

The input device manager 201 has a function of arranging the input signals from the respective input units, and deciding a switching sequence. The input device manager 201 includes an input device controller. An input signal transmitted via each interface includes a signal (such as an image signal obtained by scanning a paper document, or PDL data downloaded from the network) input from a device outside the MFP. Additionally, the input signal includes a signal processed in the MFP in a process such as reprinting the image data stored in the document manager 111, and cooperating with the RIP unit 108 and output image processor 109.

The input job controller 202 includes a protocol interpreter and a job generator. A series of operation requests sent from the input device control unit is received as an instruction signal called a command (protocol). The protocol interpreter interprets the outline of the operation requests and converts them into operation procedures understandable in the MFP. The job generator generates various jobs such as a print job, scan job, PDL expansion job, and fax reception job. Each generated job defines a scenario representing processing contents in the MFP and the sending destination. Each job flows in the MFP in accordance with the scenario.

The output job controller 203 includes a job analyzer, binder analyzer, document analyzer, and page analyzer, and creates setting information (so-called job ticket) and image information of each job.

The job analyzer analyzes details of setting information about an entire job, including the name of the document to be printed, the number of copies, designation of a discharge tray serving as an output destination, and the binder order of a job containing a plurality of binders. The binder analyzer analyzes details of setting information about an entire binder, including setting of the binding method, staple position, and the document order of a binder containing a plurality of documents.

The document analyzer analyzes details of setting information about an entire document, including the page order of a document containing a plurality of pages, designation of double-sided printing, and attachment of covers and inserted sheets.

The page analyzer analyzes details of setting information about all of the various setting pages, including the image resolution and the image orientation (landscape/portrait). When the PDL data is input, the page analyzer invokes the RIP unit to execute a rasterizing process. In order to generate image information, the RIP unit is invoked to execute the rasterizing process, thereby generating page image information. The page image information is compressed by the compressor/decompressor 110 and stored in the document manager 111 in association with the setting information.

The output device manager 204 includes a device assignor and an output device controller. Image information stored in the document manager 111 is decompressed by the compressor/decompressor 110, and read out together with the associated setting information. The setting information and image information are sent to the output device manager 204 as a pair.

When assigning an output device on the basis of the defined scenario of each job, the device assignor arbitrates device conflict that occurs in simultaneous processing of a plurality of jobs. The output device controller schedules a device to be used, e.g., the printer 113 or post processor 114.

<Hardware Arrangement of MFP>

Figure 3:
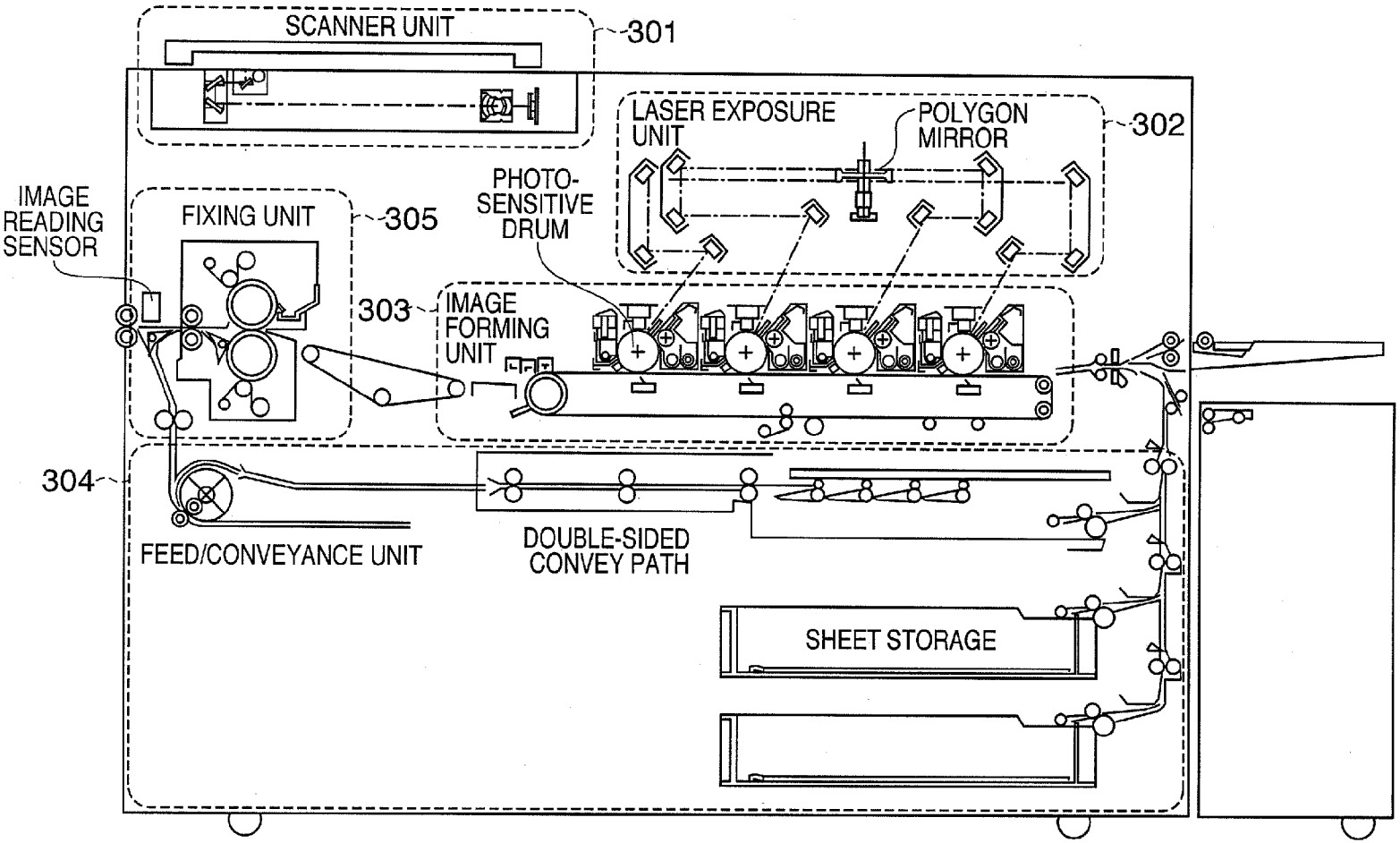
FIG. 3 is a view showing the hardware arrangement (except for a post processor) of a 4D color MFP.

The hardware arrangement of a 4D color MFP (Multi Function Peripheral) (except for the post processor 114) will be explained with reference to FIG. 3. The 4D color MFP includes a scanner unit 301, laser exposure unit 302, image forming unit 303, fixing unit 305, feed/conveyance unit 304, and a printer controller (not shown) to control them.

The scanner unit 301 illuminates a document placed on the document table, optically reads the document image, and converts the image into an electrical signal to create image data.

The laser exposure unit 302 sends a light beam such as a laser beam modulated in accordance with the image data to a rotary polyhedral mirror (polygon mirror) rotating at a uniform angular velocity and irradiates a photosensitive drum with reflected scan light.

The image forming unit 303 rotates the photosensitive drum, causes a charger to charge the photosensitive drum, develops, with toner, a latent image formed on the photosensitive drum by the laser exposure unit, and transfers the toner image to a sheet. The image forming unit also has four developing units (developing stations) of a series of electrophotographic processes to recover a very small amount of toner remaining on the photosensitive drum without being transferred.

The four developing units are arranged in the order of cyan (C), magenta (M), yellow (Y), and black (K). Magenta, yellow, and black image forming operations are sequentially executed after the elapse of a predetermined time from the start of image formation of the cyan station. With this timing control, a full-color toner image without color misregistration is transferred to a sheet.

The fixing unit 305 is formed by combining rollers and belts and incorporates a heat source such as a halogen heater.

The toner on the sheet with the toner image being transferred by the image forming unit is fused and fixed on the sheet by heat and pressure.

The feed/conveyance unit 304 has at least one sheet storage represented by a sheet cassette or paper deck. The feed/conveyance unit 304 separates one of a plurality of sheets stored in a sheet storage and conveys the sheet to the image forming unit 303 and fixing unit 305 in accordance with an instruction from the printer controller. A toner image of each color is transferred to the conveyed sheet by the above-described developing station so that a full-color toner image is finally formed on the sheet. To form images on both surfaces of the sheet, the sheet that has passed through the fixing unit 305 is controlled to pass through a convey path to convey the sheet to the image forming unit 303 again.

The printer controller communicates with the MFP controller 106 to control the entire MFP and executes control in accordance with an instruction from the MFP controller. The printer controller also outputs instructions such that it can smoothly operate in harmony while managing the states of the above-described scanner unit 301, laser exposure unit 302, image forming unit 303, fixing unit 305, and feed/conveyance unit 304.

The sheet which has passed through the fixing unit 305 passes through an image reading sensor on the convey path, and the printed image data is read by the image reading sensor. The read image data is used to measure the density of the output image and detect whether the output image is normal.

<Arrangement of RIP Unit 108>

Figure 4:
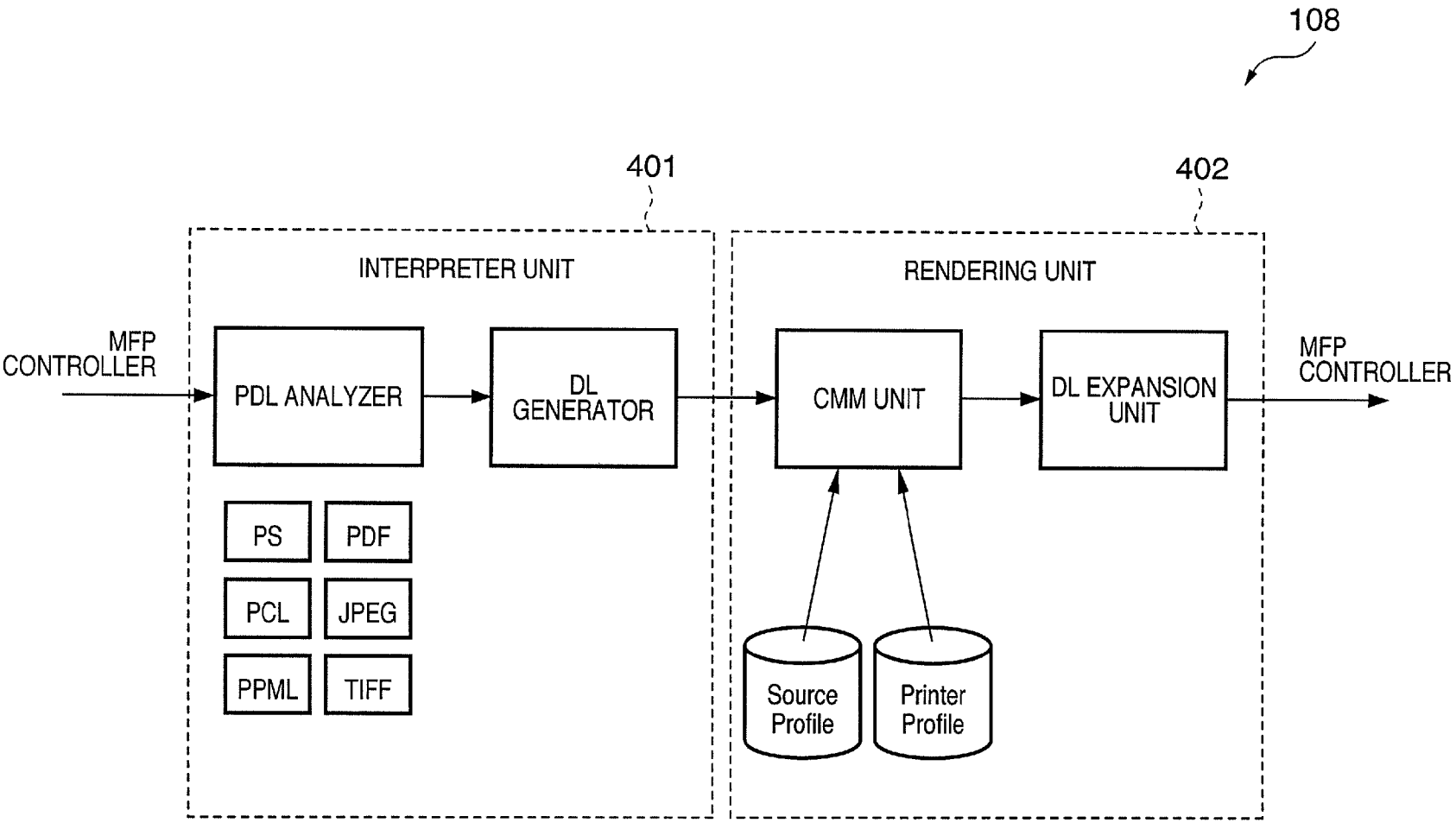
FIG. 4 is a block diagram of a RIP unit.

The arrangement of the RIP unit 108 will be described below with reference to FIG. 4.

A RIP (Raster Image Processor) is a processor for rasterizing object information in a bitmap format (raster image) on the memory to simultaneously reproduce the object information as one page. For example, the object information includes vector information of, e.g., characters, line arts, and graphics described by PDL (Page Description Language), or image scanning line information of, e.g., colors, patterns, and photos. This processor was installed on the output device side as hardware previously, but is implemented by software currently because of the increase in processing speed of a CPU.

The RIP unit 108 generally includes two parts, i.e., an interpreter unit 401 and a rendering unit 402. The interpreter unit 401 includes a PDL interpreter to translate PDL data, and a DL (Display List) generator to generate an intermediate file called a display list from the interpreted PDL data. The rendering unit 402 includes a CMM (Color Matching Module) unit to execute color matching for the display list and a DL expansion unit which expands the display list to bitmap data (raster image).

The PDL interpreter analyzes various kinds of input PDL data. Popular input formats are PostScript® available from Adobe and PCL (Printer Control Language) available from HP (Hewlett-Packard).

These data are described by printer control codes to create an image of each page and include not only simple character codes but also graphics drawing codes and photo image codes. PDF (Portable Document Format), i.e., a document display file format developed by Adobe is also widely used in various industries. This format which is directly input to the MFP without using a driver is also processed by the PDL interpreter.

The PDL interpreter also copes with a VDP (Variable Data Print) format called PPML (Personalized Print Markup Language) and color image compression formats such as JPEG (Joint Photographic Experts Group) and TIFF (Tagged Image File Format).

The CMM unit can receive various image data such as grayscale, RGB, and CMYK data. Any other color space is temporarily converted into the CMYK space by CRD (Color Rendering Dictionary) and subjected to color matching. The CMM unit adjusts the colors by using an ICC profile.

The ICC profile includes a source profile and a printer profile. The source profile temporarily converts RGB (or CMYK) data into a normalized L*a*b* space, and converts the L*a*b* data into a CMYK space suitable for the target printer again. In this case, the source profile includes an RGB profile and a CMYK profile. When the input image is an RGB image (e.g., application software available from Microsoft or a JPEG or TIFF image), the RGB profile is selected. For a CMYK image (e.g., some data of Photoshop® or Illustrator® available from Adobe), the CMYK profile is selected.

The printer profile is created in accordance with the color characteristic of each printer. For an RGB image, "Perceptual" (color tint priority) or "Saturation" (brightness priority) is preferably selected. For a CMYK image, "Colorimetric" (minimum color difference) is generally selected to output an optimum image.

The ICC profile generally has a lookup table format. When RGB (or CMYK) data is input, the source profile uniquely converts the data into L*a*b* data. On the other hand, the printer profile converts the L*a*b* data into CMYK data that matches the printer. Note that RGB data that requires no color matching is converted into CMYK data by default color conversion, and then output. CMYK data that requires no color matching is output without any processing. The image data expanded by the RIP unit 108 is held by the document manager 111 via the compressor/decompressor 110.

<Arrangement of Output Image Processor 109>

Figure 5:
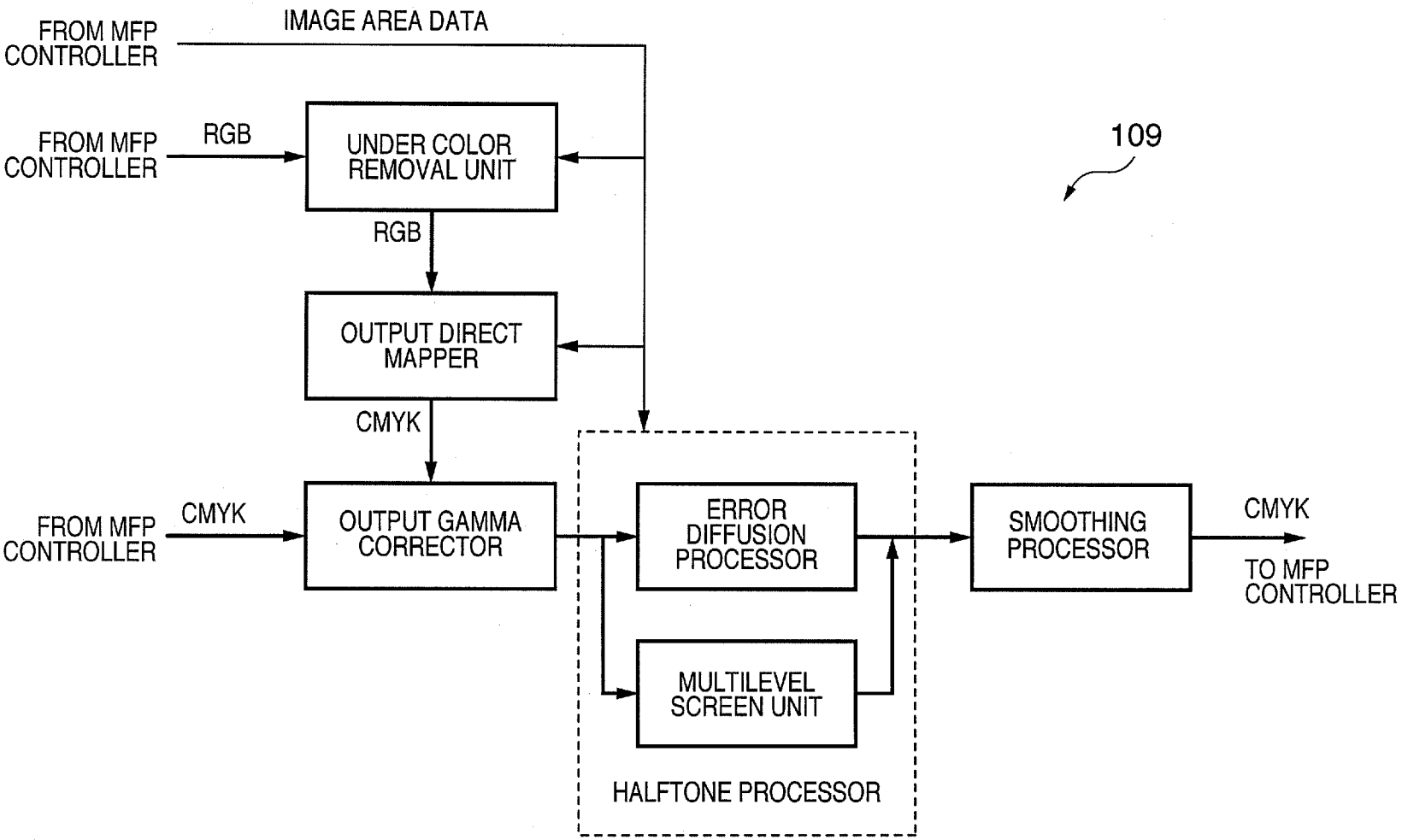
FIG. 5 is a block diagram of an output image processor (color system)

The output image processor 109 will be described below with reference to FIG. 5.

Image data input to the output image processor (color system) 109 can mainly be classified into RGB data that handles output data from the input image processor 101 by, e.g., copy operation, and CMYK data that handles output data from the RIP unit 108 by, e.g., network print operation. The former is input to a undercolor removal unit, and the latter is input to an output gamma corrector.

The undercolor removal unit executes nonlinear conversion for RGB image data read by the scanner unit 301 to remove the undercolor portion on the basis of the result of the printer unit 113.

An output direct mapper converts the RGB image data into CMYK image data. In this conversion, the RGB values are input to the lookup table, and the sum of the output values is set to a cyan (C) component. Magenta (M), yellow (Y), and black (K) components are also created by the lookup table and adding operation. In this case, the 3D lookup tables are used on the basis of image area data detected by the input image processor 101, and different lookup tables are applied to a character area and a photo area.

The output gamma corrector corrects the density of an output image corresponding to the printer. The output gamma corrector maintains the linearity of the output-image data, which changes in every image formation cycle, by using a 1D lookup table for each of CMYK data. Generally, a color calibration result is reflected on this lookup table.

A halftone processor can selectively apply different kinds of screening in accordance with the MFP function. Generally, in, e.g., copy operation, error diffusion type screening that hardly generates any moire is used. In the print operation, multilevel screen type screening that uses, e.g., a dither matrix considering the reproducibility of characters and thin lines is often used. In the former operation, a pixel of interest and neighboring pixels are weighted by using an error diffusion filter to distribute and correct a multilevel error while maintaining the number of tone levels. On the other hand, the latter sets the threshold value of a dither matrix to multilevel values and digitally expresses the halftone. CMYK data is independently converted, and the low and high LPIs (Line Per Inches) are switched on the basis of input image data to reproduce the data.

A smoothing processor detects an edge portion of each of the CMYK data by pattern matching, and converts the data into a more smoothly reproducible pattern, thereby reducing jaggies.

<Arrangement of Inline Finisher Unit (Post Processor) 114>

Figure 6:
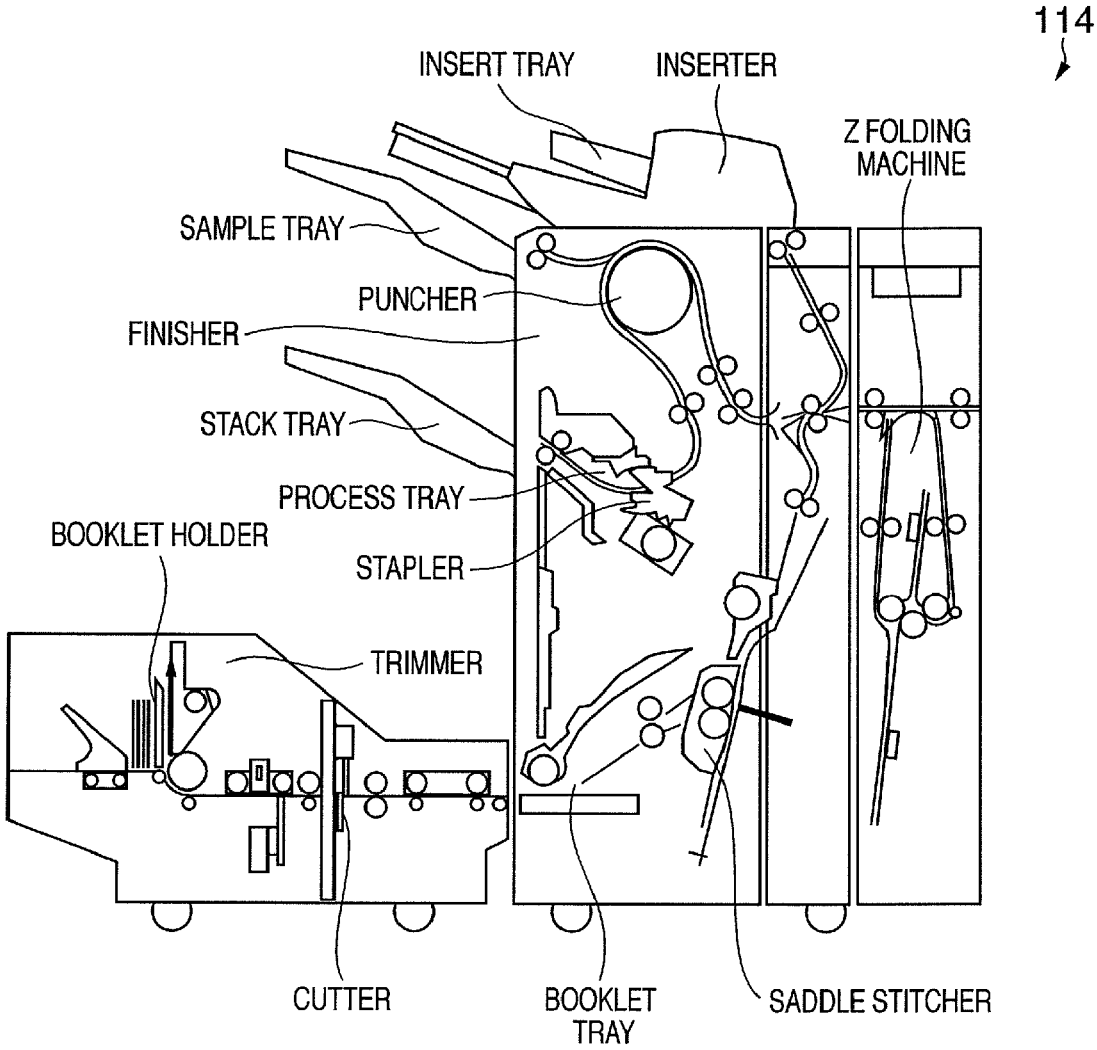
FIG. 6 is a view showing the arrangement of a post processor.

The arrangement of the inline finisher unit (post processor) 114 will be described below with reference to FIG. 6. FIG. 6 is a sectional view of the inline finisher unit 114.

When the inline finisher is connected, a sheet discharged from the fixing unit 305 of the printer 113 enters the inline finisher 114. The inline finisher 114 has a sample tray and a stack tray and switches the discharge tray in accordance with the job type or the number of sheets to discharge the sheets.

Sorting can be done by two sorting schemes: a bin sort scheme which distributes sheets to a plurality of bins and a shift sort scheme which distributes output sheets for each job by an electronic sorting function and an operation of shifting a bin (or tray) in the back and forth directions.

The electronic sorting function is called "collate". When a core unit has a large-capacity memory, the electronic sorting function can also be supported by using the so-called collate function of changing the buffered page order and discharge order by using a buffer memory.

A grouping function sorts sheets for each page, unlike the sorting function that distributes sheets for each job.

If a staple mode is set for a job to be output, sheets are controlled to be discharged to the stack tray. In this case, the sheets are sequentially stored in a process tray in the finisher before discharge to the stack tray, and bound by a stapler on the process tray. Then, the bundle of sheets is discharged to the stack tray.

In addition, a Z folding machine to fold a paper sheet into a Z-shape and a puncher to form two (or three) holes for filing. Each processing is executed in accordance with the job type. For example, when the user sets Z folding by operating the operating unit 107 in sheet processing for the job to be output, folding by the Z folding machine is executed for each sheet of the job. Then, control is performed to make the paper sheet pass through the inline finisher and discharge it to the discharge tray such as the stack tray or sample tray.

For example, when punching is set via the operation unit 107 by a user in sheet processing for the job to be output, punching by the puncher is executed for each sheet of the job. Then, control is performed to make the paper sheet pass through the inline finisher and discharge it to the discharge tray such as the stack tray or sample tray.

A saddle stitcher executes processing (bookbinding) of binding sheets at two points of the central portion, inserting the sheets between rollers to fold them at the center to make a booklet such as a pamphlet. The sheets bound by the saddle stitcher are discharged to a booklet tray. The execution enable/disable state of sheet processing such as bookbinding by the saddle stitcher is also based on sheet processing setting that is done by the user for the job to be output, as described above.

An inserter sends sheets set in an insert tray to one of the discharge trays such as the stack tray and sample tray without letting the sheets pass through the printer. With this structure, the sheets set in the inserter can be inserted between sheets sent to the inline finisher unit 114 (sheets printed by the printer unit 113). The user sets the sheets in the insert tray of the inserter in a face-up state and sequentially fed from the uppermost one by a pickup roller.

Hence, the sheets from the inserter are directly conveyed to the stack tray or sample tray and discharged in a face-down state. To send a sheet to the saddle stitcher, the sheet is temporarily sent to the puncher side and then switched back to the saddle stitcher such that all sheets face in the same direction. The execution enable/disable state of sheet insert processing by the inserter is also based on sheet processing setting that is done by the user for the job to be output, as described above.

A trimmer (cutting machine) will be described next. The trimmer receives an output booklet (saddle-stitched booklet) formed by the saddle stitcher. Rollers feed the output booklet by only a predetermined length, and a cutter cuts it by only a predetermined length. Hence, even when the edge lengths of a plurality of pages of the booklet are uneven, the edges are cut to an even length. The booklet is stored in a booklet holder. The execution enable/disable state of cutting processing by the trimmer is also based on sheet processing setting that is done by the user for the job to be output, as described above.

<Outline of Detection Process of Detecting Presence/Absence of Printing Failure>

FIG. 7 shows a process of checking (detecting the presence/absence of a printing failure) the output image of a print job for which a cutting process by the post processor 114 is set.

Figure 7A:
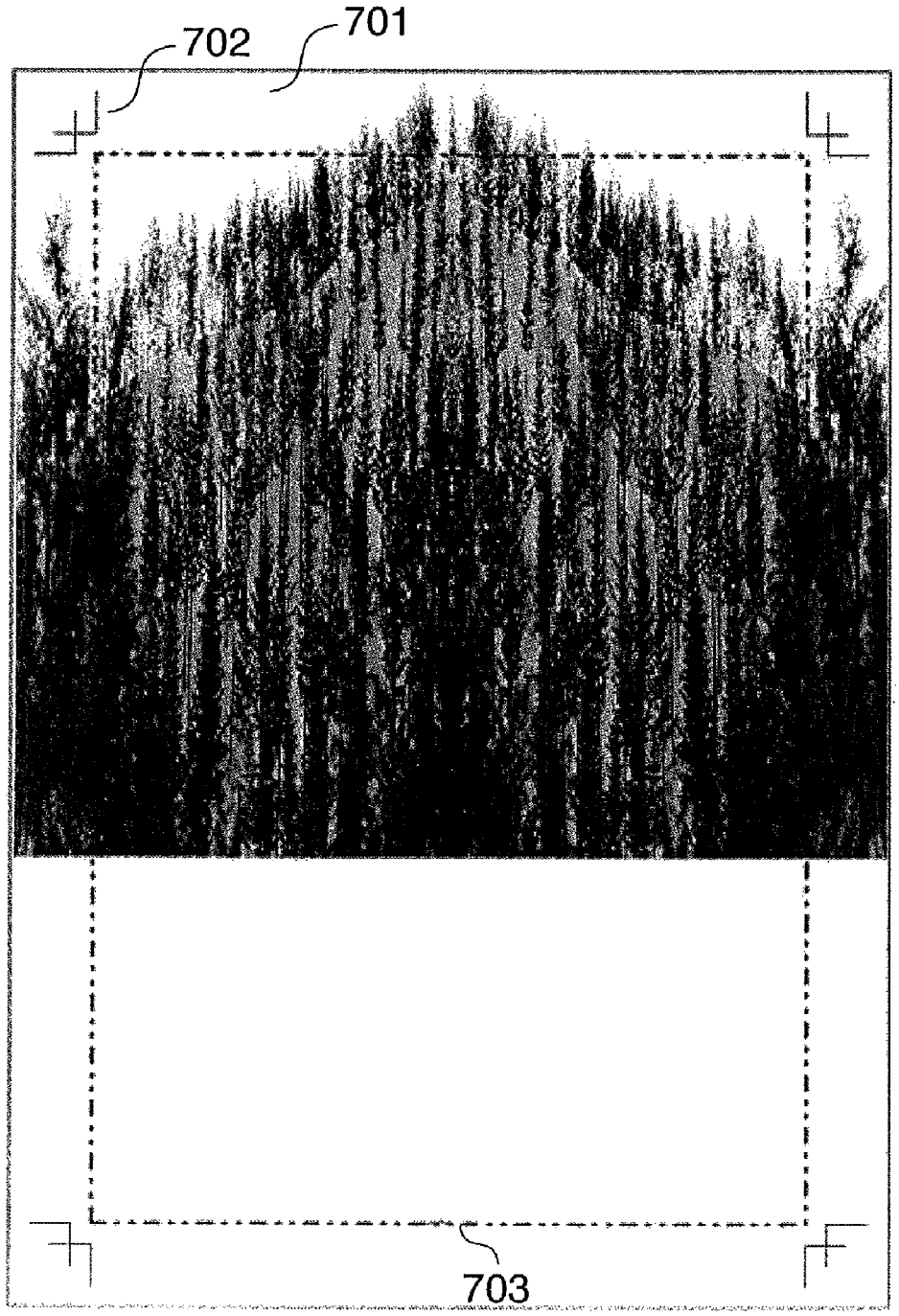
FIG. 7A is a view showing an example of the output image of a job for which a cutting process is set.

FIG. 7A shows a state wherein image data is printed on a sheet. The image data is printed on the entire surface of an output sheet 701. Trim marks 702 are printed on the four corners of the sheet to perform the cutting process by the post processor 114. The cutting machine cuts the end portions of the sheet with reference to the positions of these marks. That is, the sheet is cut along a chain double-dashed line 703 shown in FIG. 8. As a result, a printed product after the cutting process is an image 704 shown in FIG. 7B.

A process of detecting the presence/absence of a printing failure on the printed product will be described next. The printed product is read by an image reading sensor of the printer unit 113 in the MFP, and the read image data is transmitted to the MFP controller 106. The MFP controller 106 compares the image data transmitted from the printer unit 113 with the image data decompressed by the RIP unit 108 and stored in the document manager 111. In this case, in comparing these image data, all pixels may be compared for each pixel if accuracy is important (accuracy-oriented mode), or pixels may be compared every several pixels if processing speed is important (processing speed-oriented mode). A user may set the mode to be used in advance by using the operation unit 107 of the MFP, or can designate the mode to be used when the print job is to be executed.

Figure 7B:
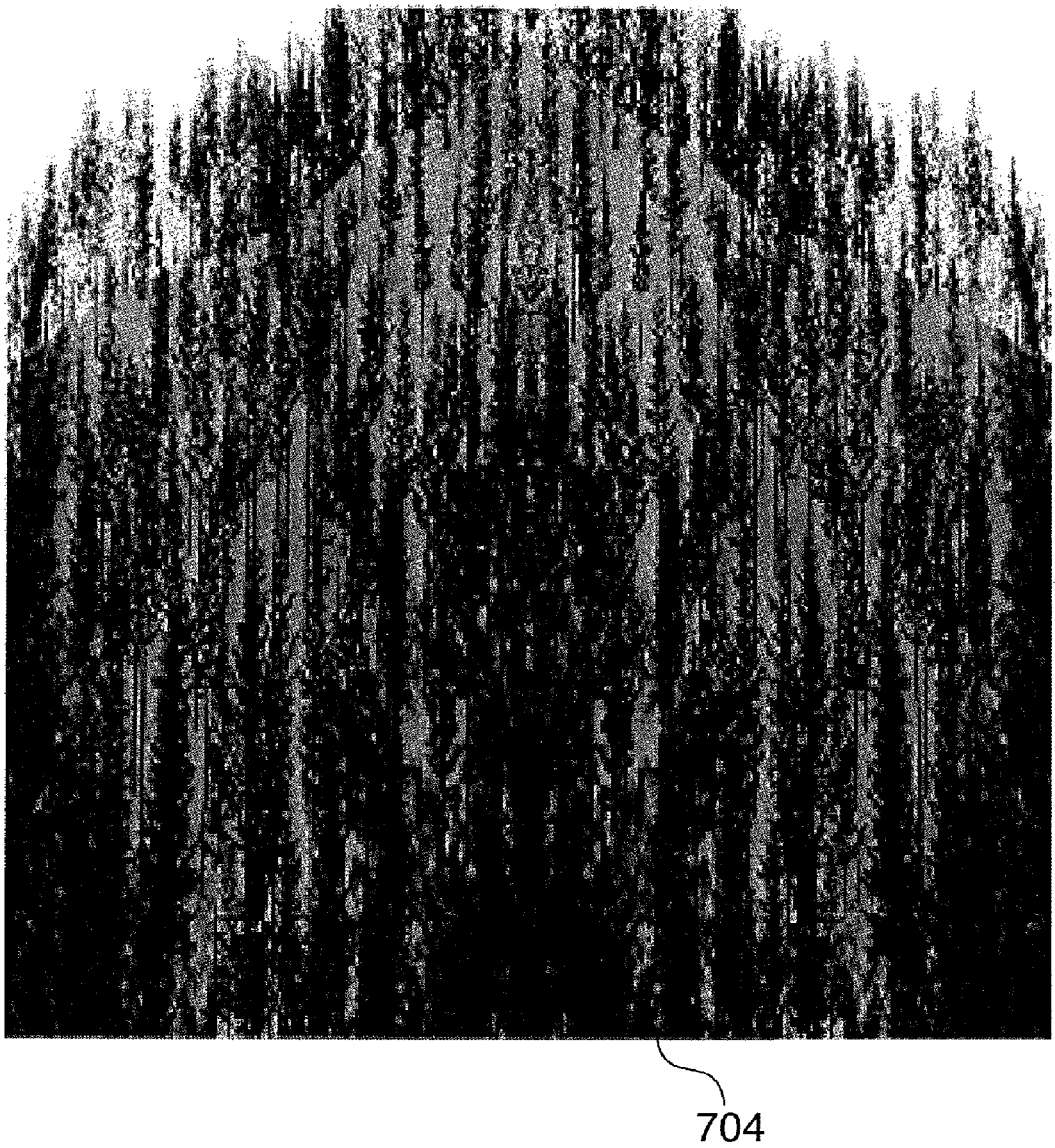
FIG. 7B is a view showing an example of the output image of the job for which the cutting process is set.

As shown in FIGS. 7A and 7B, when the cutting process is performed by the post processor 114, the printed image data is the image shown in FIG. 7A. However, the image data to be delivered as a final printed product to a customer is the image shown in FIG. 7B.

Figure 8:
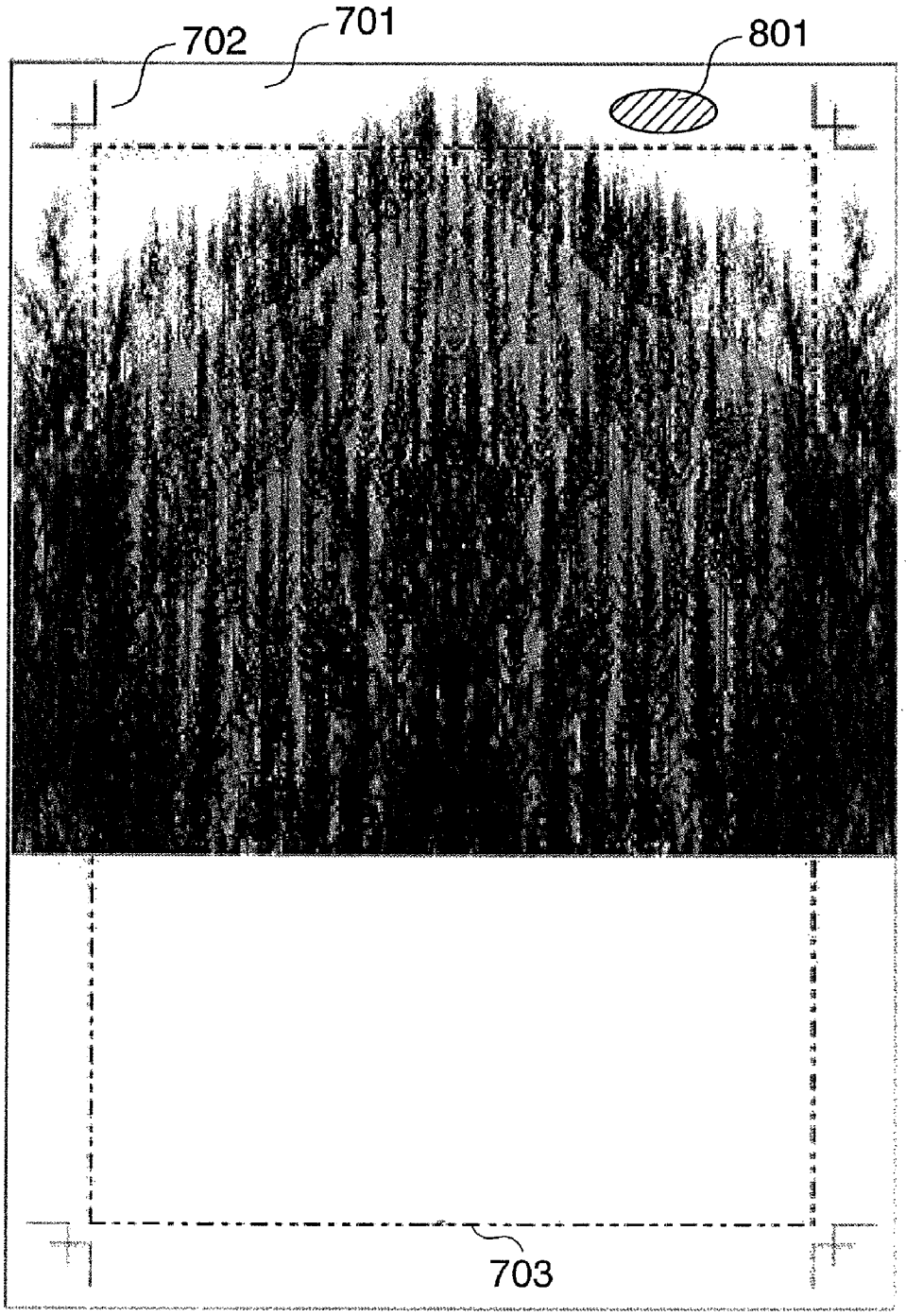
FIG. 8 is a view showing an example when dirt is attached on the output image of the job for which the cutting process is set.

In this case, as shown in FIG. 8, assume that there is dirt 801 on the output sheet 701. In the process of detecting the presence/absence of the printing failure in this state, the portion of dirt 801 is detected as an error by comparing the expanded image data and the printed product.

However, since the portion of dirt 801 is to be cut away in the cutting process by the post processor 114, it need not be treated as an error. Hence, when the cutting process by the post processor 114 is instructed to be performed, the expanded image data must be compared with only an image 704 in FIG. 7B which is to be left even after the cutting process. Assume that this comparison target image data area is determined by the MFP controller 106 on the basis of setting of the post processor 114 in the print job. Note that a comparison target image area may be automatically detected with reference to cutting marks (trim marks 702) in the image data read by the image reading sensor.

<Flow of Detection Process of Detecting Presence/Absence of Printing Failure (When Comparison Target is Specified Based on Print Job Setting Value)>

Figure 9:
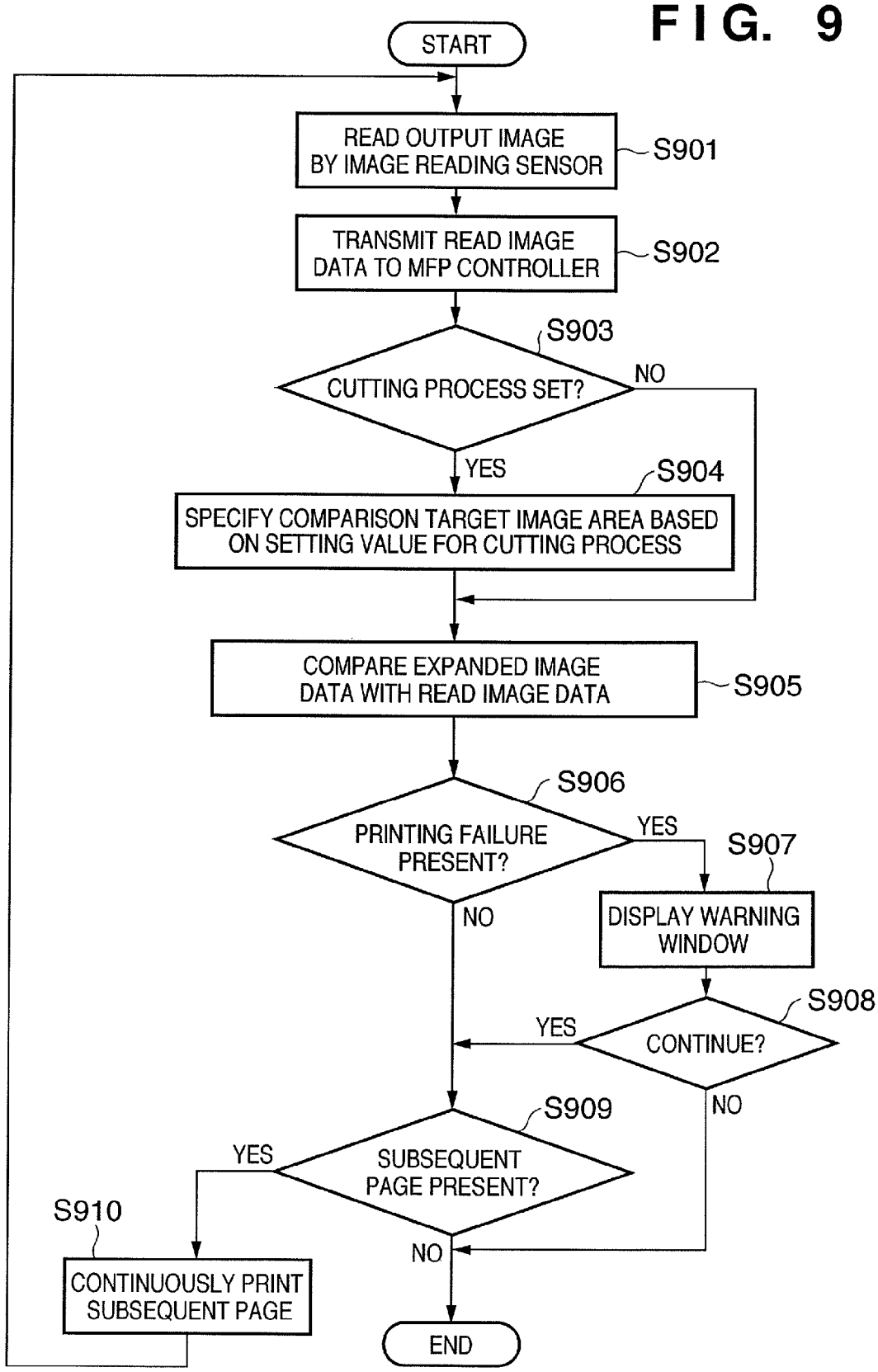
FIG. 9 is a flowchart showing the flow of processing of detecting the presence/absence of a printing failures

FIG. 9 is a flowchart showing the flow of processing of detecting the presence/absence of a printing failure.

When printing is started, the image reading sensor arranged at a discharge position reads a printed image (step S901). The read image data is transmitted to the MFP controller 106 (step S902).

The MFP controller 106 checks whether the cutting process is set for the print job (step S903). If the cutting process is set, a comparison target image area in the read image data is specified based on the setting value in the cutting process (step S904).

If no cutting process is set for the job, or if the cutting process is set to specify the comparison target image area based on the setting value, the flow advances to step S905. In step S905, the presence/absence of the printing failure is detected by comparing the image area corresponding to the decompressed image data and the read image data.

If it is determined that the printing failure is present as a result of comparison (YES in step S906), a warning window is displayed on the operation unit 107 or a screen (not shown) (step S907). On the warning window, a window which prompts a user to continue or stop printing is displayed (step S908). If the user instructs to stop printing, printing ends.

If the user instructs to continue printing, or if no printing failure is present, it is checked whether a subsequent page is present (step S909). If no subsequent page is present, printing ends. If a subsequent page is present, the subsequent page is continuously printed (step S910). The processes in steps S901 to S910 are repeated until the last page is printed.

<Flow of Detection Process of Detecting Presence/Absence of Printing Failure (When Comparison Target is Specified Based on Printed Product)>

Figure 10:
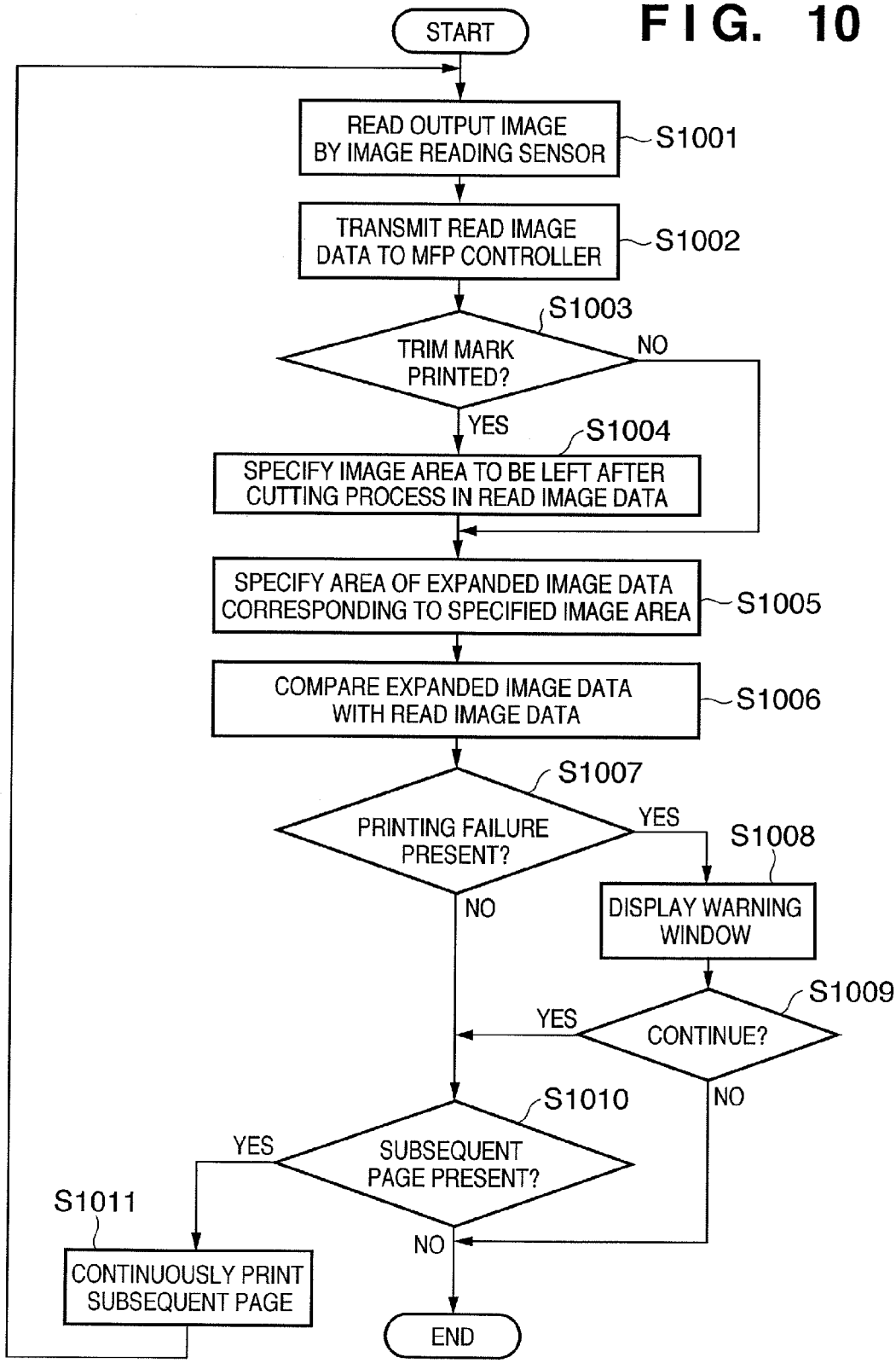
FIG. 10 is a flowchart showing the flow of processing of automatically determining a comparison target image data area from readout image data.

FIG. 10 is a flowchart showing the flow of processing of automatically determining a comparison target image data area from readout image data.

When printing is started, the image reading sensor arranged at a discharge position reads a printed image (step S1001). The read image data is transmitted to the MFP controller 106 (step S1002).

The MFP controller 106 searches whether a trim mark is present in the read image data (step S1003).

If the trim mark is found, the MFP controller 106 specifies an image area to be left after the cutting process in the read image data (step S1004). If no trim mark is found, or if the image area to be left after the cutting process is specified, the MFP controller 106 specifies an expanded image data area corresponding to the specified image area (step S1005).

When the comparison target image area is specified, the MFP controller 106 detects the presence/absence of the printing failure by comparing the expanded image data and the read image data (step S1006). If it is determined that the printing failure is present as a result of comparison (YES in step S1007), a warning window is displayed on the operation unit 107 or a screen (not shown) (step S1008).

On the warning window, a window which prompts a user to continue or stop printing is displayed (step S1009). If the user instructs to stop printing, printing ends. If the user instructs to continue printing, or if no printing failure is present, it is checked whether a subsequent page is present (step S1010). If no subsequent page is present, printing ends. If a subsequent page is present, the subsequent page is continuously printed (step S1011). The processes in steps S1001 to S1011 are repeated until the last page is printed.

As described above, the MFP according to this embodiment detects the presence/absence of the printing failure on all printed products in printing. As a result, the defective product can be prevented from mixing in the printed products to be delivered to the customer.

When the cutting process is set as the post process, the setting value for the cutting process set for the print job is used to specify the image area to be left after the cutting process. The expanded image data is compared with only the image data corresponding to the specified image area to determine the presence/absence of the printing failure. Accordingly, the presence/absence of the printing failure can be efficiently detected.

Note that the comparison target image area can also be specified on the basis of a mark (trim mark) printed in the read image data, which is used for the cutting process.

Second Embodiment

The first embodiment has described the detection method of detecting the presence/absence of a printing failure when the cutting process is set. The second embodiment will describe a process for a job for which a staple process is set, i.e., a job for printing upon shifting an image printing position for the staple process.

Figure 11A:
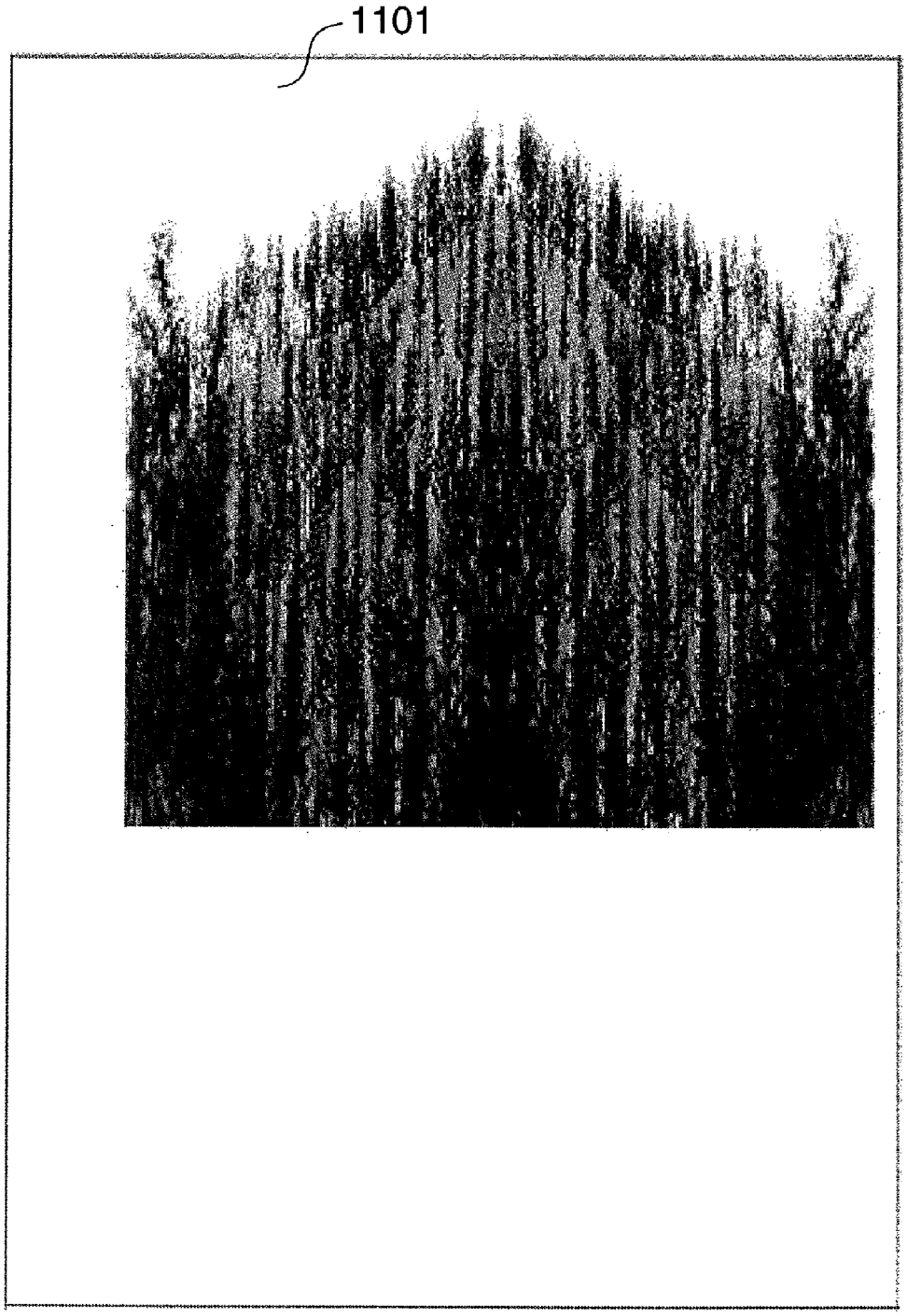
FIG. 11A is a view showing an example of the output image of a job for which a staple process is set.
Figure 11B:
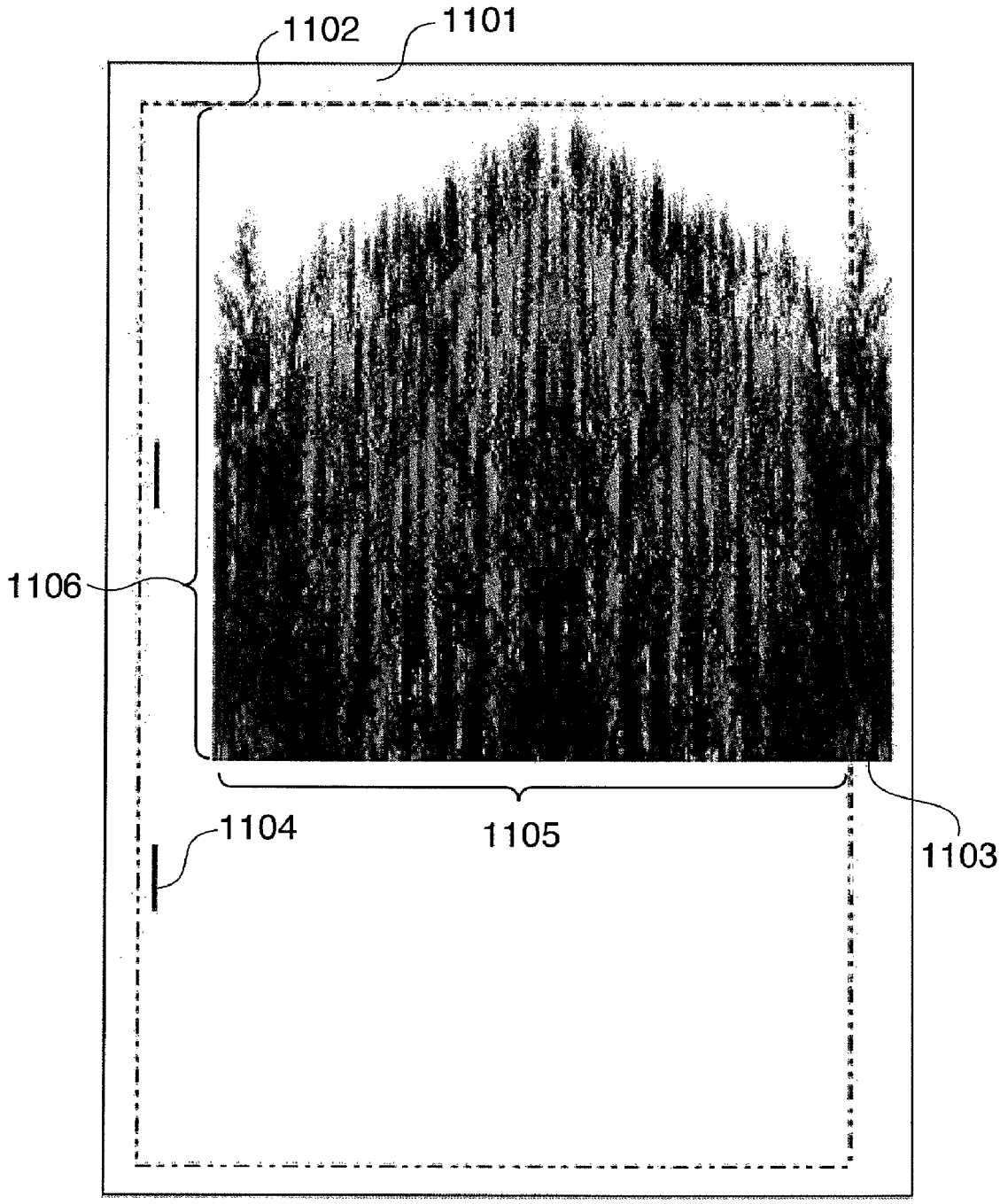
FIG. 11B is a view showing an example of the output image of the job for which the staple process is set.

FIG. 11A shows expanded image data 1101. FIG. 11B shows a printed product which is output and subjected to the staple process.

As shown in FIG. 11B, in the decompressed image data, the position of the image data to be printed is an area 1102 represented by a chain double-dashed line in FIG. 11B. On the other hand, in the actual printed product, the printing position is shifted to an area 1103, and the image data is printed to ensure an area for a staple 1104. This process is automatically performed for a job for which the staple process is designated on a printing apparatus side in order to prevent a problem that the image of a final printed product is partially hidden since the printed product is stapled at the position of the printed image data. Note that a user who prints may arbitrarily set a shift amount for the print job.

Figure 12:
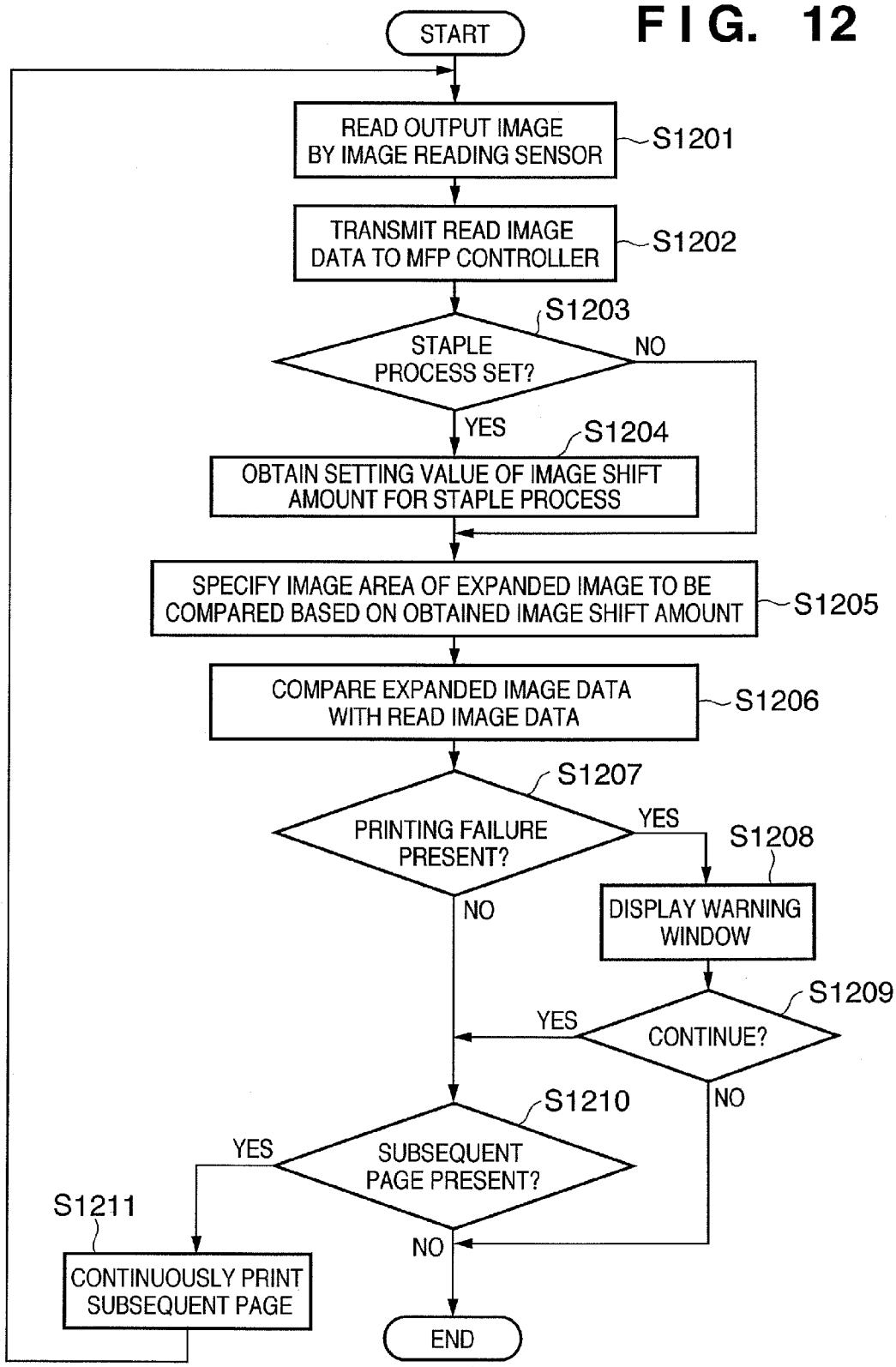
FIG. 12 is a flowchart showing the flow of processing of printing the job for which the staple process is set.

FIG. 12 is a flowchart showing the flow of processing of printing the job for which the staple process is set.

Printing is started, and the image reading sensor arranged at a discharge position reads a printed image (step S1201). The read image data is transmitted to an MFP controller 106 (step S1202).

The MFP controller 106 checks whether the staple process is set for the print job (step S1203). If the staple process is set, the MFP controller 106 obtains the setting value of an image shift amount for the staple process (step S1204).

When no staple process is set for the job, or when the staple process is set and the setting value of the image shift amount is obtained, the comparison target image area in the expanded image data is specified on the basis of the obtained image shift amount (step S1205). This image area is an area which is defined by lines 1105 and 1106, except for an area 1103 shifted from the area 1102 by shifting the image.

The presence/absence of the printing failure is detected by comparing the image area corresponding to the decompressed image data with the read image data (step S1206). If it is determined that the printing failure is present as a result of comparison (YES in step S1207), a warning window is displayed on an operation unit 107 or a screen (not shown) (step S1208).

On the warning window, a window which prompts a user to continue or stop printing is displayed (step S1209). If the user instructs to stop printing, printing ends. If the user instructs to continue printing, or if no printing failure is present, it is checked whether a subsequent page is present (step S1210). If no subsequent page is present, printing ends. If a subsequent page is present, the subsequent page is continuously printed (step S1211). The processes in steps S1201 to S1211 are repeated until the last page is printed.

As described above, the MFP according to this embodiment detects the presence/absence of the printing failure on all printed products in printing. As a result, the defective product can be prevented from mixing in the printed products to be delivered to the customer.

When the position of the image data to be printed is deviated from the position of the image data obtained by reading the printed product in order to execute the staple process or the like as the post process, the comparison target image area is specified based on the image shift amount set in the print job. Accordingly, the presence/absence of the printing failure can be efficiently detected.

Other Embodiment

Note that the present invention may be applied to either a system constituted by a plurality of devices (e.g., a host computer, an interface device, a reader, a printer, and the like), or an apparatus consisting of a single device (e.g., a copying machine, a facsimile apparatus, or the like).

The objects of the present invention are also achieved by supplying a storage medium, which records a program code of a software program that can realize the functions of the above-mentioned embodiments to the system or apparatus, and reading out and executing the program code stored in the storage medium by a computer (or a CPU or MPU) of the system or apparatus. In this case, the storage medium which stores the program code constitutes the present invention.

As the storage medium for supplying the program code, for example, a floppy® disk, hard disk, optical disk, magneto-optical disk, CD-ROM, CD-R, magnetic tape, nonvolatile memory card, ROM, and the like may be used.

The functions of the above-mentioned embodiments may be realized not only by executing the readout program code by the computer but also by some or all of actual processing operations executed by an OS (operating system) running on the computer on the basis of an instruction of the program code.

Furthermore, the functions of the above-mentioned embodiments may be realized by some or all of actual processing operations executed by a CPU or the like arranged in a function extension board or a function extension unit, which is inserted in or connected to the computer, after the program code read out from the storage medium is written in a memory of the extension board or unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-235489, filed Aug. 15, 2005, which is hereby incorporated by reference herein in its entirety.

What is claimed is:

1. A printing apparatus which executes a printing process for a print medium, comprising:

an input unit configured to input first image data to be printed on the print medium;

a printing processing unit configured to execute the printing process for the print medium based on the first image data input by said input unit;

a reading unit configured to read the print medium on which the first image data is printed by said printing processing unit to obtain second image data used to determine a presence/absence of a printing failure;

a detection unit configured to detect marks for specifying a portion of the second image data based on the second image data obtained by the reading unit;

a specifying unit configured to specify the portion of the second image data based on the marks detected by the detection unit in a case where the detection unit detects the marks, and to specify a whole of the second image data in a case where the detection unit does not detect the marks; and a determination unit configured to determine the presence/absence of the printing failure by comparing the first image data and the portion of the second image data in a case where said detection unit detects the marks, and to determine the presence/absence of the printing failure by comparing the first image data and the whole of the second image data in a case where said detection unit does not detect the marks.

2. A printing processing method for a printing apparatus which executes a printing process for a print medium, the printing process method comprising:

inputting first image data to be printed on the print medium;

executing the printing process for the print medium based on the input first image data;

reading the print medium for which the printing process has been executed based on the first image data to obtain second image data used to determine a presence/absence of a printing failure;

detecting marks for specifying a portion of the second image data based on the obtained second image data;

specifying the portion of the second image data based on the detected marks in a case where the marks are detected, and specifying a whole of the second image data in a case where the marks are not detected; and determining the presence/absence of the printing failure by comparing the first image data and the portion of the second image data in a case where the marks are detected, and determining the presence/absence of the printing failure by comparing the first image data and the whole of the second image data in a case where the marks are not detected.

3. A non-transitory storage medium which stores a program for causing a computer to execute a printing processing method of executing a printing process for a print medium, the printing processing method comprising inputting first image data to be printed on the print medium;

executing the printing process for the print medium based on the input first image data input in the input step;

reading the print medium for which the printing process has been executed based on the first image data to obtain second image data used to determine a presence/absence of a printing failure;

detecting marks for specifying a portion of the second image data based on the obtained second image data;

specifying the portion of the second image data based on the detected marks in a case where the marks are detected, and specifying a whole of the second image data in a case where the marks are not detected; and determining the presence/absence of the printing failure by comparing the first image data and the portion of the second image data in a case where the marks are detected, and determining the presence/absence of the printing failure by comparing the first image data and the whole of the second image data in a case where the marks are not detected.

4. A printing apparatus according to claim 1, further comprising:

a notifying unit configured to notify a user of the printing apparatus in a case where it is determined by the determination unit that the printing failure is present.

5. A printing apparatus according to claim 1, further comprising:

a control unit configured to control the printing processing unit whether to continue the printing process or to stop the printing process based on an instruction by a user of the printing apparatus in a case where it is determined by the determination unit that the printing failure is present.

6. A printing processing method according to claim 2, further comprising:

notifying a user of the printing apparatus in a case where it is determined that the printer failure is present.

7. A printing processing method according to claim 2, further comprising:

controlling whether to continue the printing process or to stop the printing process based on an instruction by a user of the printing apparatus in a case where it is determined that the printing failure is present.

8. A printing apparatus which executes a printing process for a print medium, comprising:

an input unit configured to input first image data to be printed on the print medium;

a printing processing unit configured to execute the printing process for the print medium based on the first image data input by said input unit;

a reading unit configured to read the print medium on which the first image data is printed by said printing processing unit to obtain second image data used to determine a presence/absence of a printing failure;

a first determination unit configured to determine whether a predetermined sheet process for the print medium, on which the printing process is executed, should be performed or not;

a second determination unit configured to, in a case where it is determined by the first determination unit that the predetermined sheet process should be performed, perform specifying process for specifying a portion of the second image data to be used to determine the presence/absence of the printing failure and determine the presence/absence of the printing failure by comparing the first image data and the portion of the second image data; and a third determination unit configured to, in a case where it is determined by the first determination unit that the predetermined sheet process should not be performed, determine the presence/absence of the printing failure by comparing the first image data and a whole of the second image data, wherein the third determination unit does not perform the specifying process.

* * * * *